US008867767B2

(12) United States Patent
Bravo Cordero

(10) Patent No.: US 8,867,767 B2
(45) Date of Patent: Oct. 21, 2014

(54) HEARING AID MOLD

(71) Applicant: Gustavo Andres Bravo Cordero, Santiago (CL)

(72) Inventor: Gustavo Andres Bravo Cordero, Santiago (CL)

( * ) Notice: Subject to any disclaimer, the term of this patent is extended or adjusted under 35 U.S.C. 154(b) by 0 days.

(21) Appl. No.: 13/676,505

(22) Filed: Nov. 14, 2012

(65) Prior Publication Data

US 2013/0142378 A1 Jun. 6, 2013

Related U.S. Application Data

(60) Provisional application No. 61/560,410, filed on Nov. 16, 2011.

(51) Int. Cl.
*H04R 25/00* (2006.01)
*H04R 1/10* (2006.01)

(52) U.S. Cl.
CPC ..... *H04R 1/105* (2013.01); *H04R 1/1008* (2013.01); *H04R 25/658* (2013.01); *H04R 25/652* (2013.01); *H04R 1/1016* (2013.01); *H04R 1/1091* (2013.01)
USPC ..... 381/328; 381/322

(58) Field of Classification Search
CPC ..... H04R 25/65; H04R 25/652; H04R 25/658
USPC ..... 381/328, 322
See application file for complete search history.

(56) References Cited

U.S. PATENT DOCUMENTS

| | | | | |
|---|---|---|---|---|
| 4,372,904 | A * | 2/1983 | Gunn | 264/134 |
| 6,211,450 | B1 * | 4/2001 | Ishida | 84/423 R |
| 6,304,663 | B1 * | 10/2001 | Claes et al. | 381/322 |
| 6,473,513 | B1 * | 10/2002 | Shennib et al. | 381/328 |
| 7,702,124 | B2 * | 4/2010 | Niederdraenk et al. | 381/426 |
| 2004/0161445 | A1 | 8/2004 | Bulk et al. | |
| 2004/0179709 | A1 | 9/2004 | Niederdraenk et al. | |
| 2013/0345170 | A1 * | 12/2013 | Eddy | 514/63 |

* cited by examiner

*Primary Examiner* — Curtis Kuntz
*Assistant Examiner* — Ryan Robinson
(74) *Attorney, Agent, or Firm* — Merchant & Gould P.C.

(57) ABSTRACT

A mold for earpiece devices either to connect an earphone to the ear canal or to act as a cover or plug thereof, allowing to prevent the development of ear diseases comprising: a mold placed in the ear canal and/or ear shell, adjusted to its shape, and whose external border is in direct contact with the user's skin; and a metallic piece with biocide properties, located inside the mold at a distance close to the border thereof; wherein the metallic piece is adjusted from inside the mold (10) to the shape of the external contour thereof, allowing that only the mold is in direct contact with the skin, and encompassing all the zones where contact is produced.

7 Claims, 11 Drawing Sheets

HEARING AID MOLD

This application claims benefit of U.S. Provisional Ser. No. 61/560,410, filed 16 Nov. 2011 and which application is incorporated herein by reference. To the extent appropriate, a claim of priority is made to the above disclosed application.

FIELD OF APPLICATION

The present invention is related with the application of metals with biocide properties, in particular copper, in the medical industry given its antimicrobial properties. In particular, the present invention is related with molds for earpiece devices, which are in direct contact with the ear canal, and in which a metallic piece is inserted, preferentially having a plate shape with biocide properties, which can also be used in any earpiece device, such as earplugs for noise reduction, earplugs to avoid water entry, audio earphones, wireless technology earphones such as bluetooth technology, earplugs, earmuffs, audio protective devices, headsets, in such a manner that the device enables efficient prevention of ear diseases such as infectious external ear otitis in their users and potentially preventing other pathologies.

BACKGROUND

Copper is a metal widely distributed in nature. The efficacy of the antimicrobial activity of products based in copper has motivated the development of different studies aimed to know the mechanisms involved in this activity, as well as evaluating potential industrial applications for this metal.

Phyllis J Khun, a bacteriologist, demonstrated in 1983 the antimicrobial properties of copper. In 2008, the US Environmental Protection Agency (EPA) published a bibliographical review on the different properties of copper and its benefits in human health, among which its bacteriostatic, fungistatic bactericide, fungicide, and sanitation and disinfection powers are emphasized.

The effectiveness of products based in copper as antimicrobial agents has motivated scientists to design new applications in the health area.

The mechanism associated with the antibacterial activity of copper is still uncertain. Some studies suggests that copper in high concentrations can have a toxic effect on bacteria due to its tendency to alter between its different oxidation states, the generation of hydroxyl radicals, highly reactive, and being able to damage essential bacterial biomolecules. These radicals could act by substitution of essential ions conducting to interference in: protein synthesis; enzymatic activity or functions of the bacterial cell membrane. On the contrary, toxicity of host cells caused by DNA damage seems unlikely. In fact, there are observations suggesting that copper can protect host cells from DNA damage caused by hydrogen peroxide.

The molds for earpieces, such as earplugs for aquatic sports or those related to acustic trauma, audio devices and earphones in general (for example retro-auricular earpieces, intracanal earphones and completely in canal (CIC) earphones), are essential part of the devices, since the mold is the one which is adjusted to the ear of the user. For example, in the case of hypoacusia, it is required that earpiece molds are custom fabricated considering each user. Also, these earpieces allow acoustic sealing of the ear canal and acoustic modification of the aural signal. When fabricating the molds, the following aspects must be considered: comfort degree, aesthetical appeal, operative easiness, and patient tolerance to the materials. Different variations can be made to the earpiece mold in order to produce a lighter, more comfortable and more suitable earpiece depending on its application. Even molds containing inside an aural device can be fabricated. Nevertheless, sometimes users of earpieces have allergic reactions to the material of a particular mold and the mold must be replaced by a different material.

Otitis externa has been described as one of the complications associated to the prolonged use of earpiece devices, and particularly to the use of earphones and earplugs, since in order to avoid the feedback effect, the earpiece mold must completely seal the ear canal, which contributes to the development of a series of additional problems such as lack of air circulation, perturbation in earwax evacuation and facilitation of protective earwax being dissolved by humidity, thus making the skin of the ear canal more susceptible of infections caused by bacteria or fungus. Therefore, patients with hypoacusia are earphone users and develop otitis externa, whom while being in treatment for the infection must stop the use of the earphone, which results in deterioration of their sensorial capacity and their quality of life.

A solution to the previously mentioned problems is described in the document US 2004/0161445, which describes an earphone or an earphone component to be positioned in the ear canal, which comprises a biofilm inhibitory coating. The coating comprises an inorganic condensate modified by some organic groups on the base of coating compositions, including a hydrolyzed or a pre condensed of one or more compounds which can be hydrolyzed with at least one substituent which cannot be hydrolyzed, wherein at least one portion of the organic groups of the condensate include fluorine atoms and/or silver or copper colloids contained in the coating.

A similar solution is described in document US 2004/0179709, which describes at least one membrane of a miniature transducer comprising, at least in part, an hydrophobic and or oleophobic and or biofilm inhibitor coating, which due to the thickness of the coating is less than 10 μm, thus it does not affects significantly the auditory features of the transducer, and prevents the degradation of the transmission features due to humidity, or damages caused by humidity of the transducer. Additionally, the coating can contain copper or silver colloids, and preferentially comprises silver ion colloids.

Although the previously cited documents describe the use of copper ions to inhibit the formation of a biofilm in earphones, it is clearly seen that both documents disclose coatings made from compounds which can have copper ions in its compositions. Nevertheless, using copper ions in the coating composition carries different drawbacks, such as:

- In the first place, copper ions cannot be separated, which are the ones exerting the antimicrobial activity, to mix them with the polymer in the mold, and thus, they have to be released in a solution to allow them to exert their action mainly to bacterial membranes. $Cu^{2+}$ ion, being free or bonded to the polymer, will not be able to free itself from the polymer since if the bond is covalent, it will be extremely difficult to free and exert its antibacterial action.
- In second place, EPA, which is the organization certifying the antimicrobial copper properties, only approved metallic copper as having the specific features described in the present application, therefore the effectiveness of ionic copper is not proved.
- In third place, using copper ions present in coatings can produce harmful effects to the user's skin, by being the coating in direct contact with the skin, which can produce contact dermatitis and green coloring of the skin.

In consequence, it can be seen that using ionic copper in compounds destined for earphone mold coatings does not allow preventing in an sufficiently effective manner the formation of a biofilm, and thus, it neither does prevent effectively the presence of infections; which could generate further possible adverse effects on the users, produced by the direct contact of the copper and skin.

In this way, there is a need in the field of the invention to provide a mold for earpiece devices allowing to prevent, in an effective manner, potential infections, producing a positive effect in preventing otitis externa in users and allowing at the same time, avoiding direct contact of the metal with the skin, in order to avoid adverse effects to the user.

In order to overcome the problems described, a mechanism is presented in which the copper exerts its antimicrobial properties in earpiece devices comprising a metallic piece with biocide properties, preferentially made of copper, allowing to prevent in an effective way potential infections, producing a positive effect in preventing otitis externa in the user. These earpiece devices can be adjusted to the shape of the ear canal or to the ear shell, and the metallic piece is located inside, avoiding direct contact between the metallic piece and the skin. The metallic piece can be a plate and/or similar which is adjusted, from inside the mold, to the shape of the external contour of the same, covering all the zones wherein the surface of the mold is in direct contact with the skin, allowing at the same time that only said mold is in direct contact with the skin of the user.

In this way, the described earpiece device allows solving in an effective manner the deficiencies described in the state of the art by providing earpiece devices comprising a metallic piece inside, avoiding direct contact between said metallic piece and the skin, allowing at the same time the adherence of pathogenic strains to the surface of the mold, of bacteria as well as fungus, thanks to the properties that said metallic piece provides, avoiding potential infections, and producing a positive effect in preventing otitis externa in a user.

DETAILED DESCRIPTION OF THE INVENTION

Figure 1:
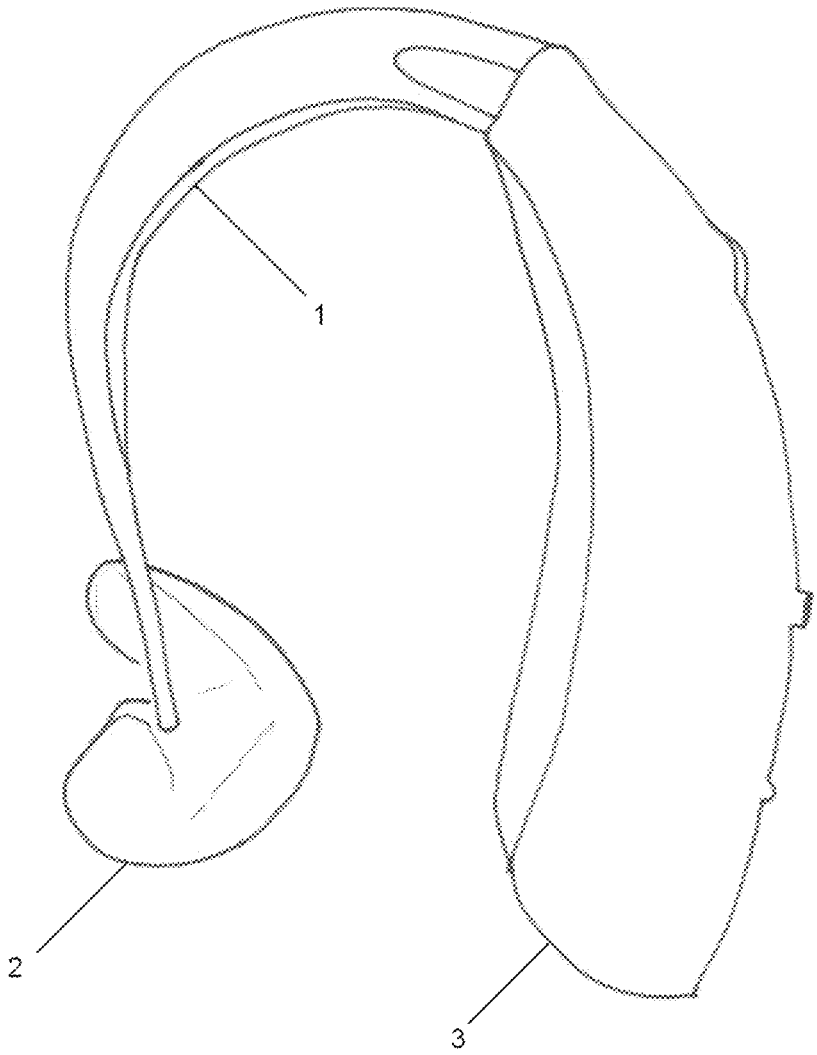
FIG. 1 shows a scheme of a retroauricular earphone, common in the previous art, indicating the parts comprising it: mold (1), elbow (2) and earphone (3).
Figure 2:
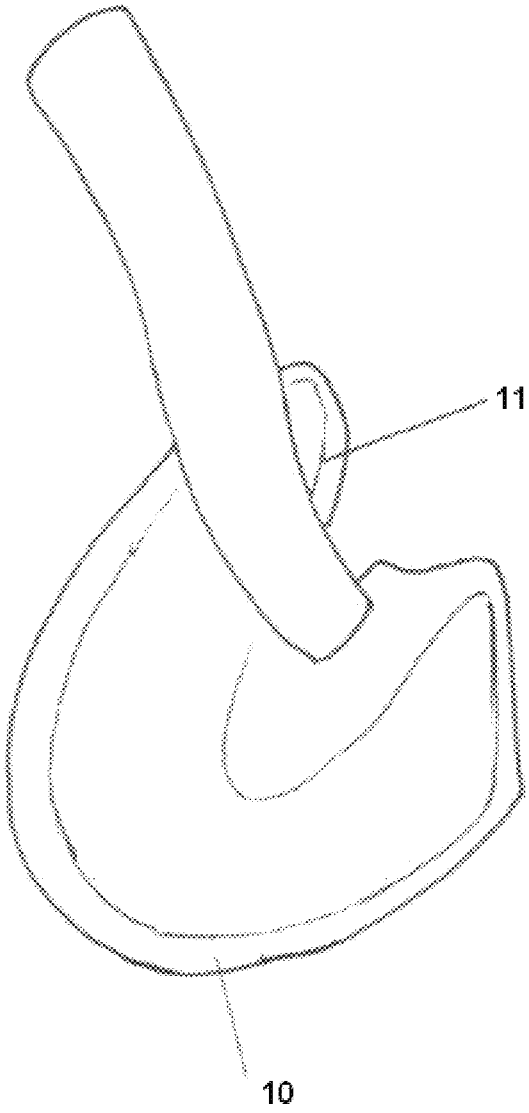
FIG. 2 shows a scheme of the retroauricular earphone mold of FIG. 1, including a metallic piece inside.
Figure 3:
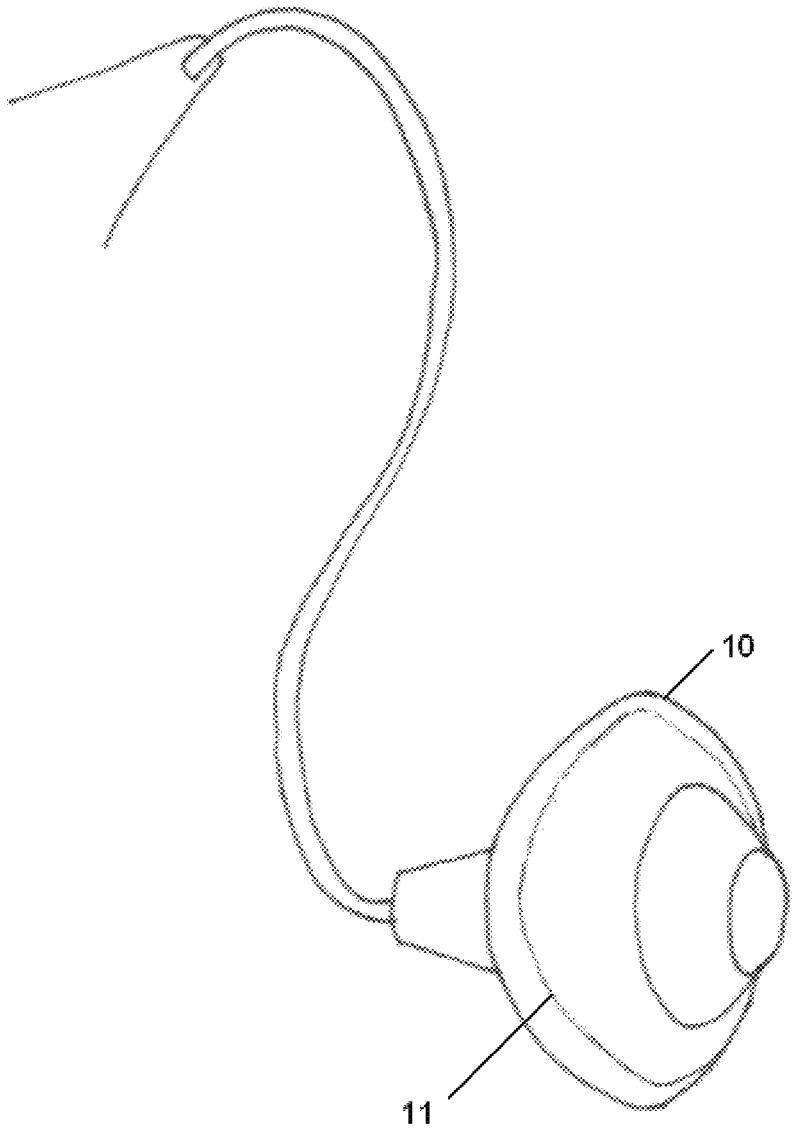
FIG. 3 shows a scheme of a retroauricular earphone mold of open mold type, known as open fit, including a metallic piece inside.
Figure 4:
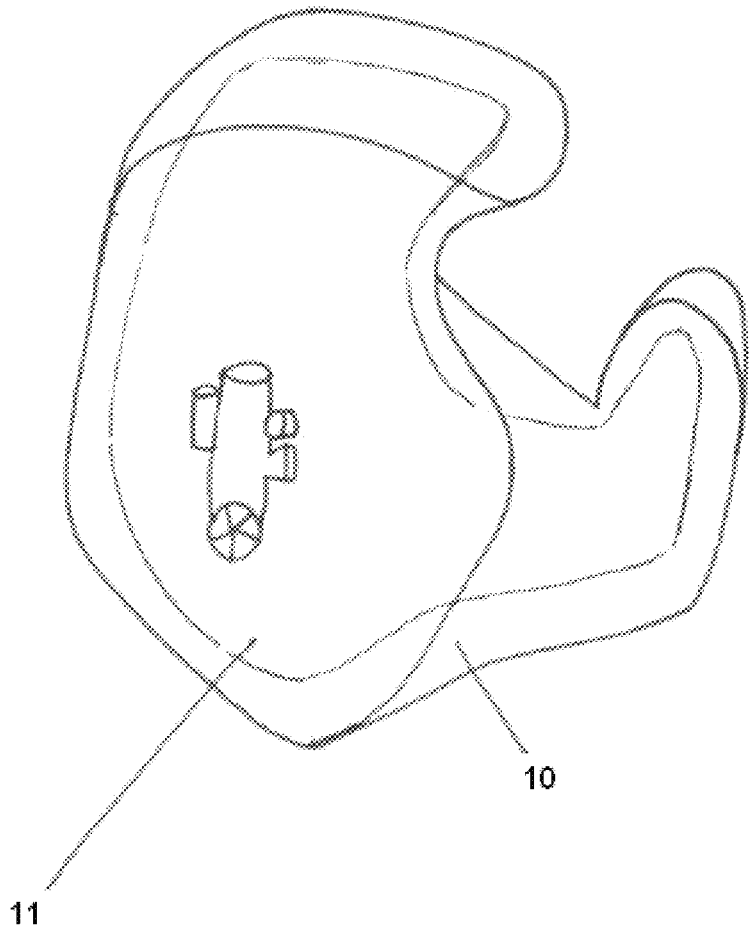
FIG. 4 shows a scheme of an earphone mold for ear shell, of full shell type, known as full shell, including a metallic plate inside.
Figure 5:
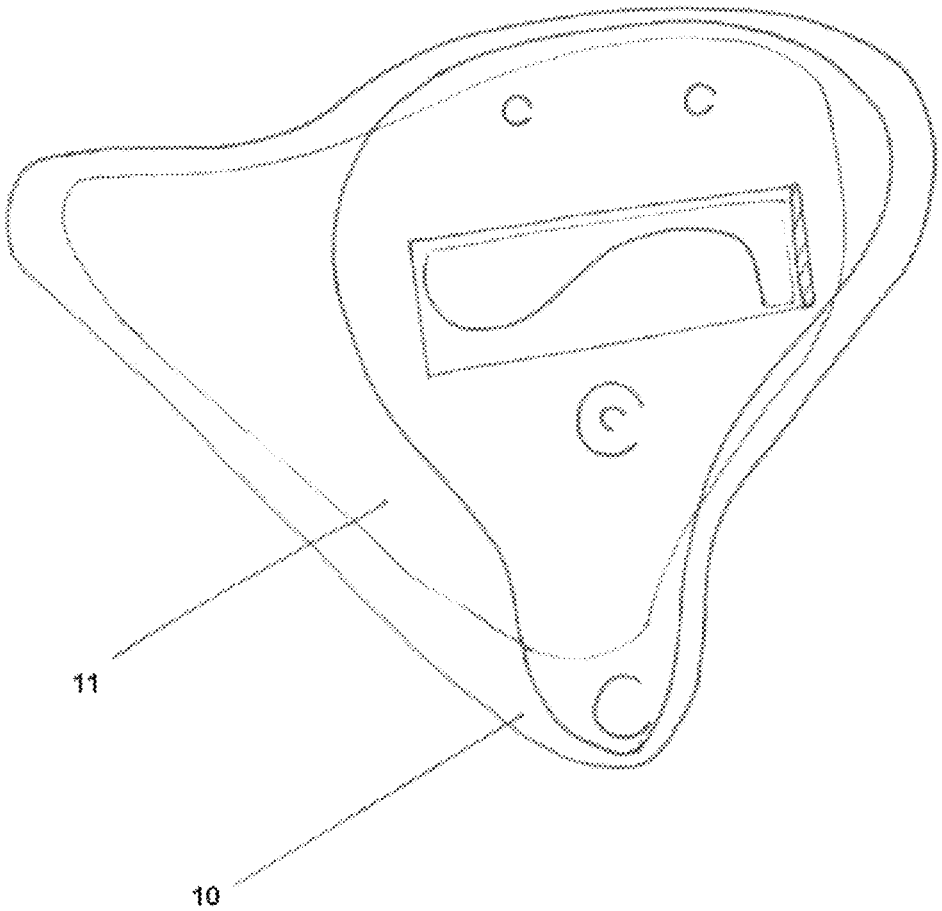
FIG. 5 shows a scheme of an earphone mold of half shell type, including a metallic plate inside.
Figure 6:
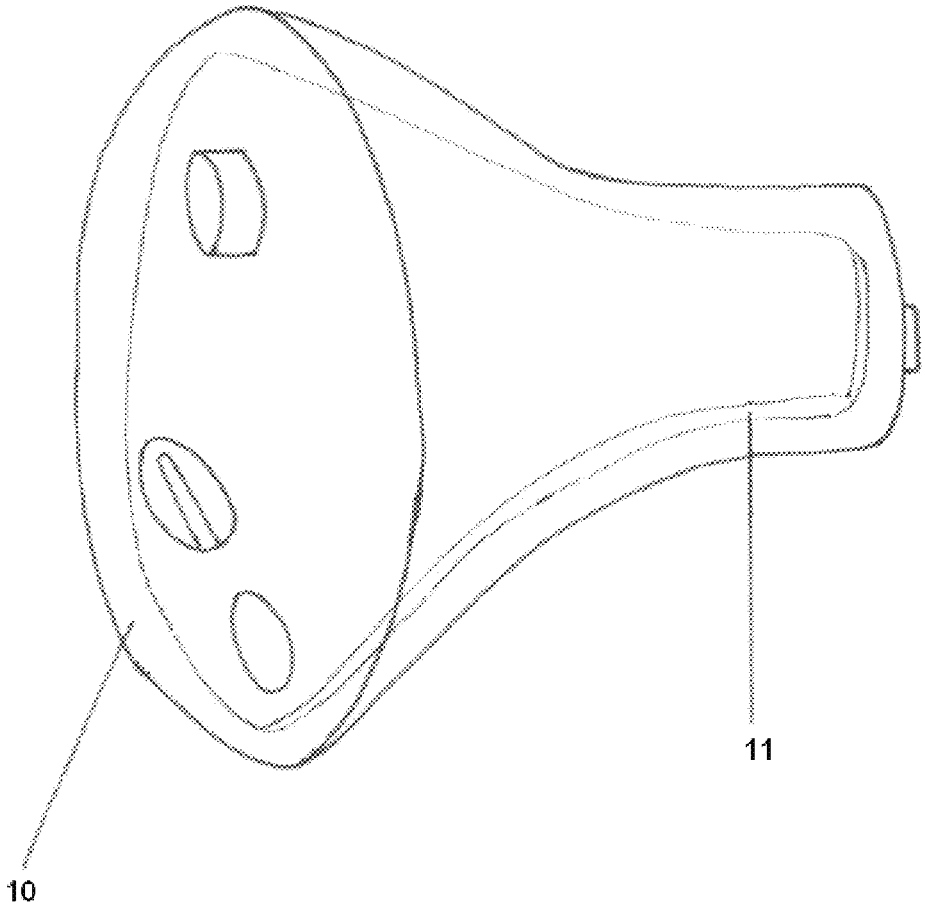
FIG. 6 shows a scheme of a canal type earphone, including a metallic plate inside.
Figure 7:
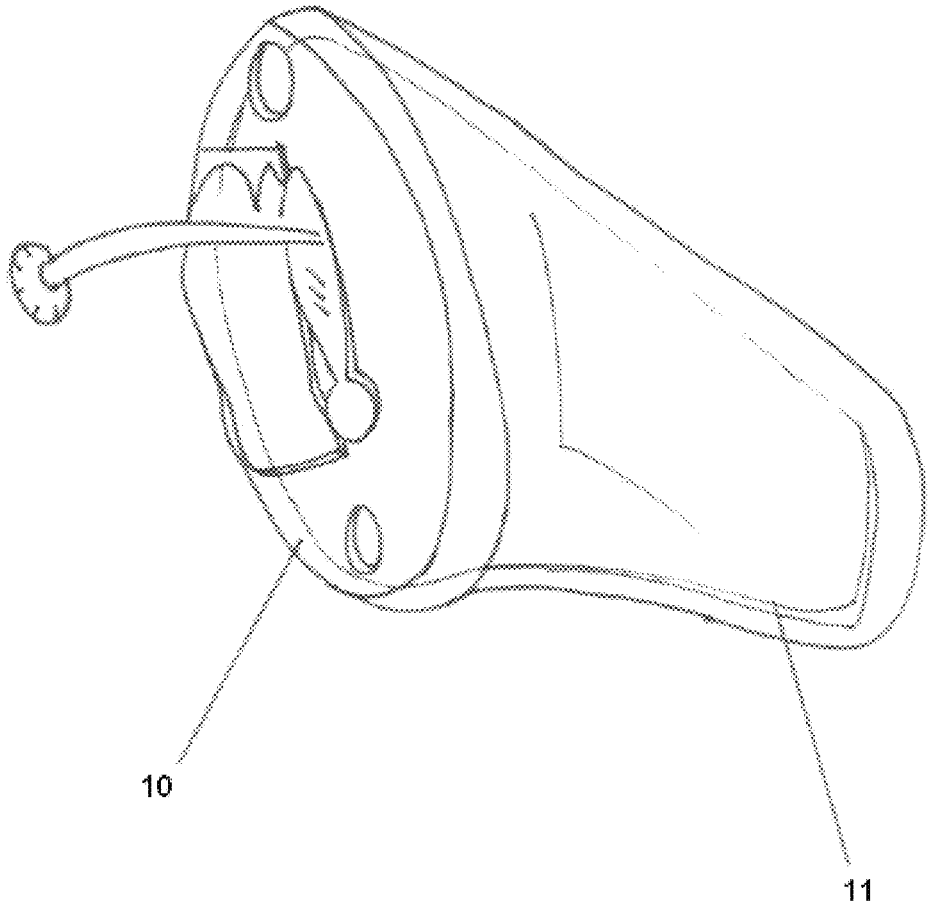
FIG. 7 shows a scheme of a CIC type earphone mold, including a metallic plate inside.

As can be seen from the figures attached to this application, the present invention corresponds to a mold for earpiece devices either to connect an earphone to the ear canal or to act as a cover or plug thereof, allowing to prevent in an effective manner potential infections, producing a positive effect in preventing otitis externa in a user, comprising:

- a device (10) which is placed in the ear canal and or in the ear shell, adjusting its shape, and whose external border is in direct contact with the user's skin; and
- a metallic piece (11) with biocide properties, placed inside the mold at a distance close to the border thereof;
- wherein the metallic piece is adjusted from inside the mold (10) to the external contour shape thereof, allowing that only the cover of the device is in direct contact with the skin, and encompassing all the zones where contact is produced.

Said metallic piece (11) with biocide properties can be made of copper or silver in pure state, or an alloy or combination thereof. Nevertheless, in a preferred embodiment of the invention, the metallic piece is only made of copper.

Also, the metallic piece is preferentially a metallic plate (11) which is placed at a distance close to the external border of the mold (10), which can be at a distance between 0.1 mm to 2 mm, it was proven that it can also be between 0.3 mm to 10 mm and has a better effect if the thickness of the copper plate is higher. On the other hand, the metallic plate (11) can have different thickness, between 0.1 mm and 3 mm.

In alternative embodiments of the invention, the material used for the fabrication of the external mold (10) is selected among acrylic, silicon or UV sensitive polymers, vinyl, polyethylene, plastics, polyurethane, elastomeric polymers, PVC, or mixtures thereof. Nevertheless, the mold for earpiece devices described can use any type of external material for the fabrication of an external mold (10), as long as it complies with the functions of the mold and device previously mentioned.

On the other hand, given the features of the metallic piece (11), which is adjusted to the shape of the border of the external surface of the mold (10), the mold for earpiece devices can be used in different types of devices, such as for example, molds for earphones as described in FIGS. 1 to 7, or other devices such as earplugs for aquatic sports, plugs related to acoustic trauma or audio devices in direct contact with the ear canal.

Regarding the capacity of avoiding formation of a biofilm in the external surface of the mold, there are bibliographical records indicating the effects of copper as an antimicrobial agent, for copper without any coating as well as copper mixed with other materials, nevertheless, there is not information about the effects of copper being coated by different materials which can be used in fabricating molds for earpiece devices, from where it is inferred that one of the mechanisms of antimicrobial action is that the copper ions (which are the ones exerting the reducing power) are transferred or diffused through the material of the mold.

Figure 8:
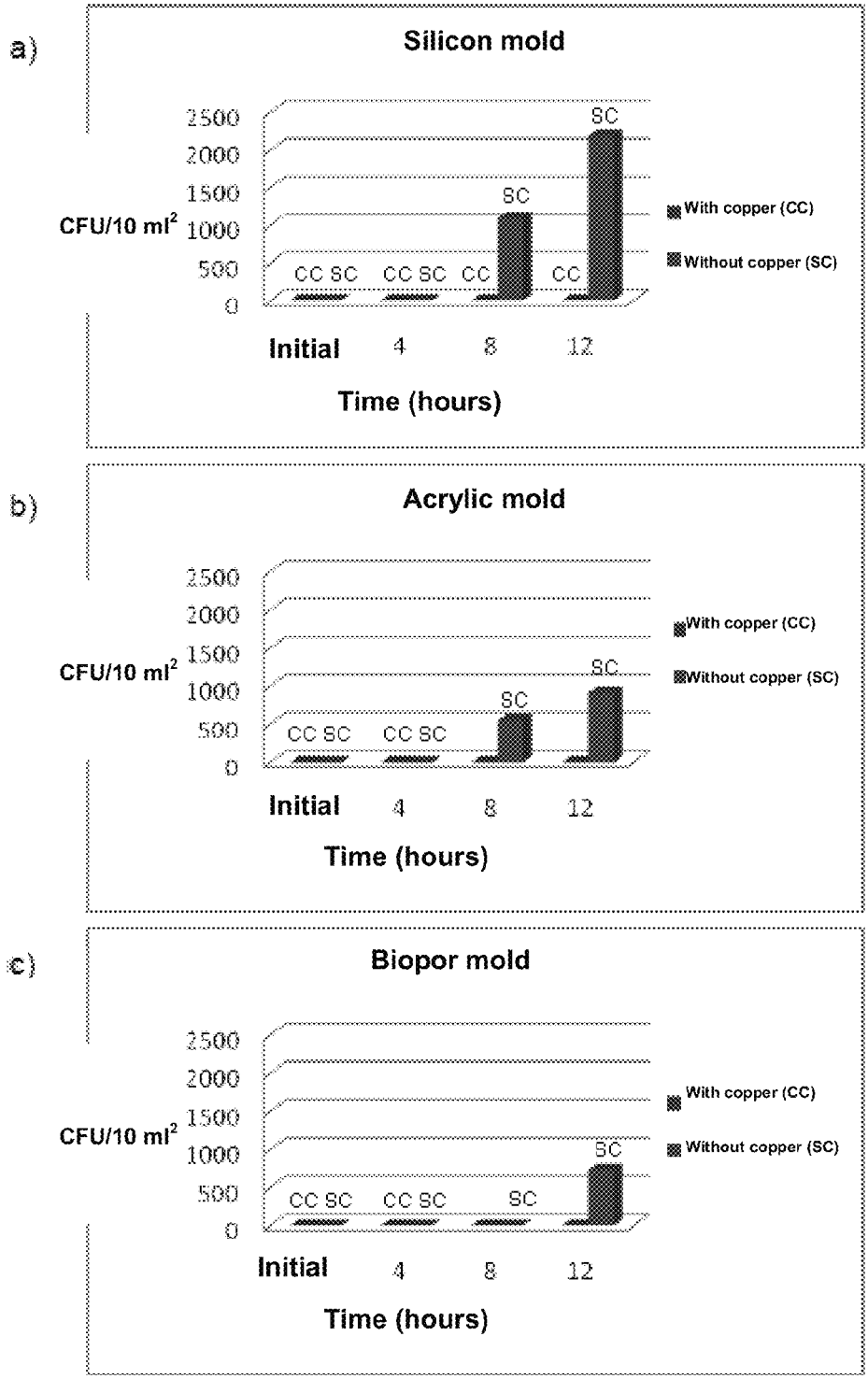
FIG. 8 shows a comparison between the adherence of *Stapylococcus aureus* using an initial inoculum of $1.8\times10^3$ CFU/ml, for different materials used as mold for earphones, including a copper plate inside or lacking the copper plate.
Figure 9:
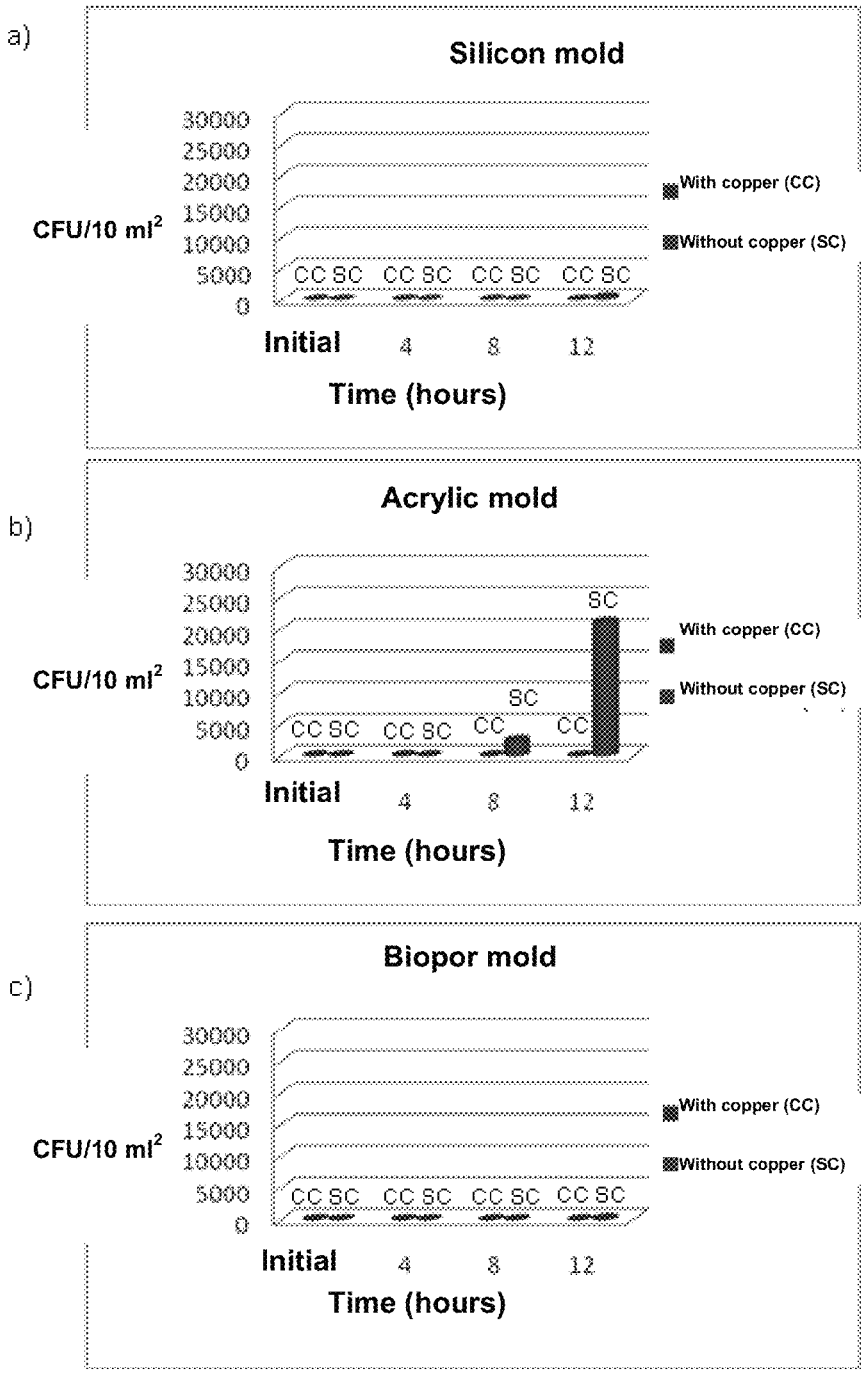
FIG. 9 shows a comparison between the adherence of *Pseudomona aeruginosa* ATCC 28753 using an initial inoculum of $4.2\times10^3$ CFU/ml, for different materials used as mold for earphones, including a copper plate inside or lacking the copper plate.
Figure 10:
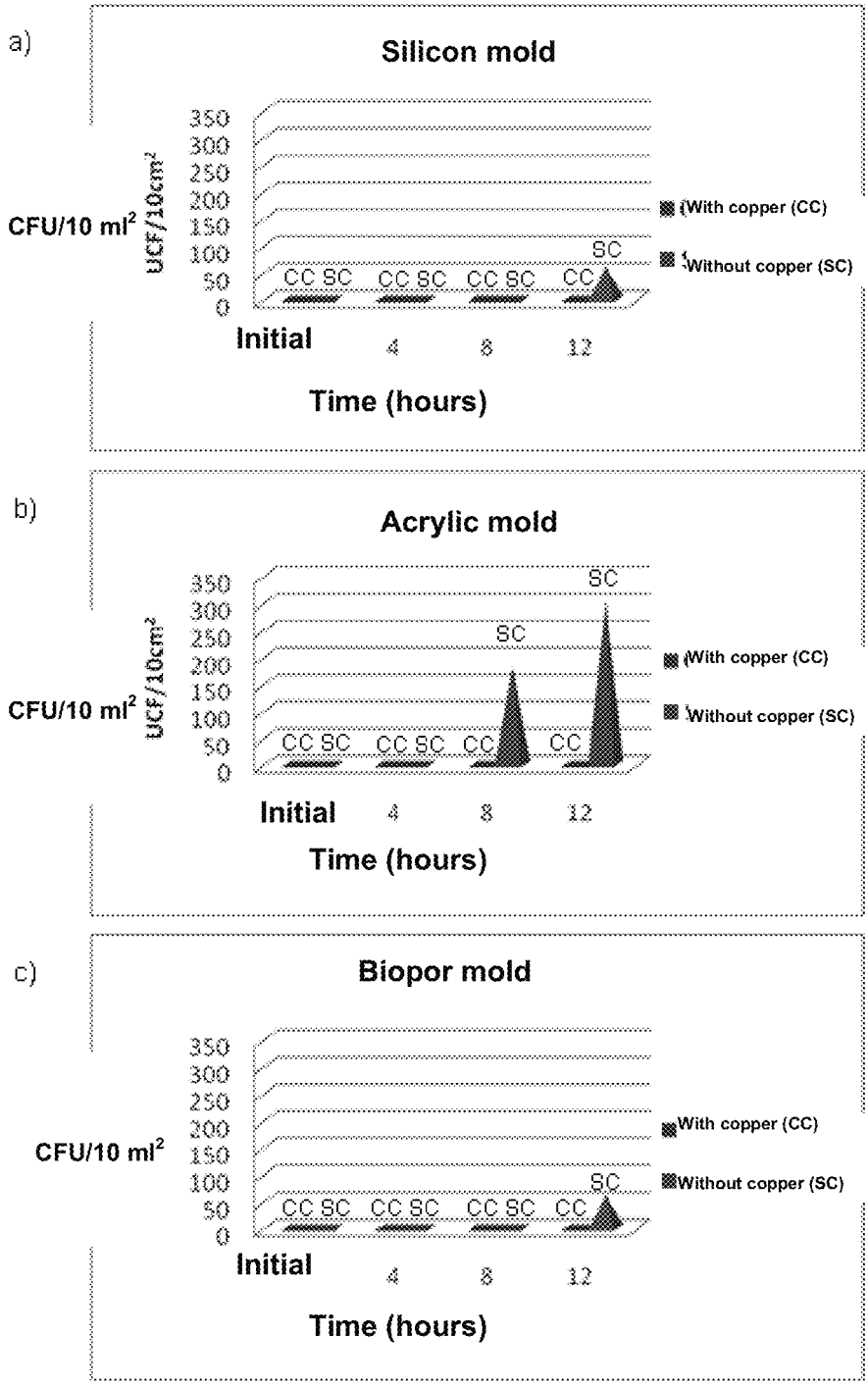
FIG. 10 shows a comparison between the adherence of *Candida albicans* ATCC 10231 using an initial inoculum of $3.6\times10^3$ CFU/ml, for different materials used as mold for earphones, including a copper plate inside or lacking the copper plate.
Figure 11:
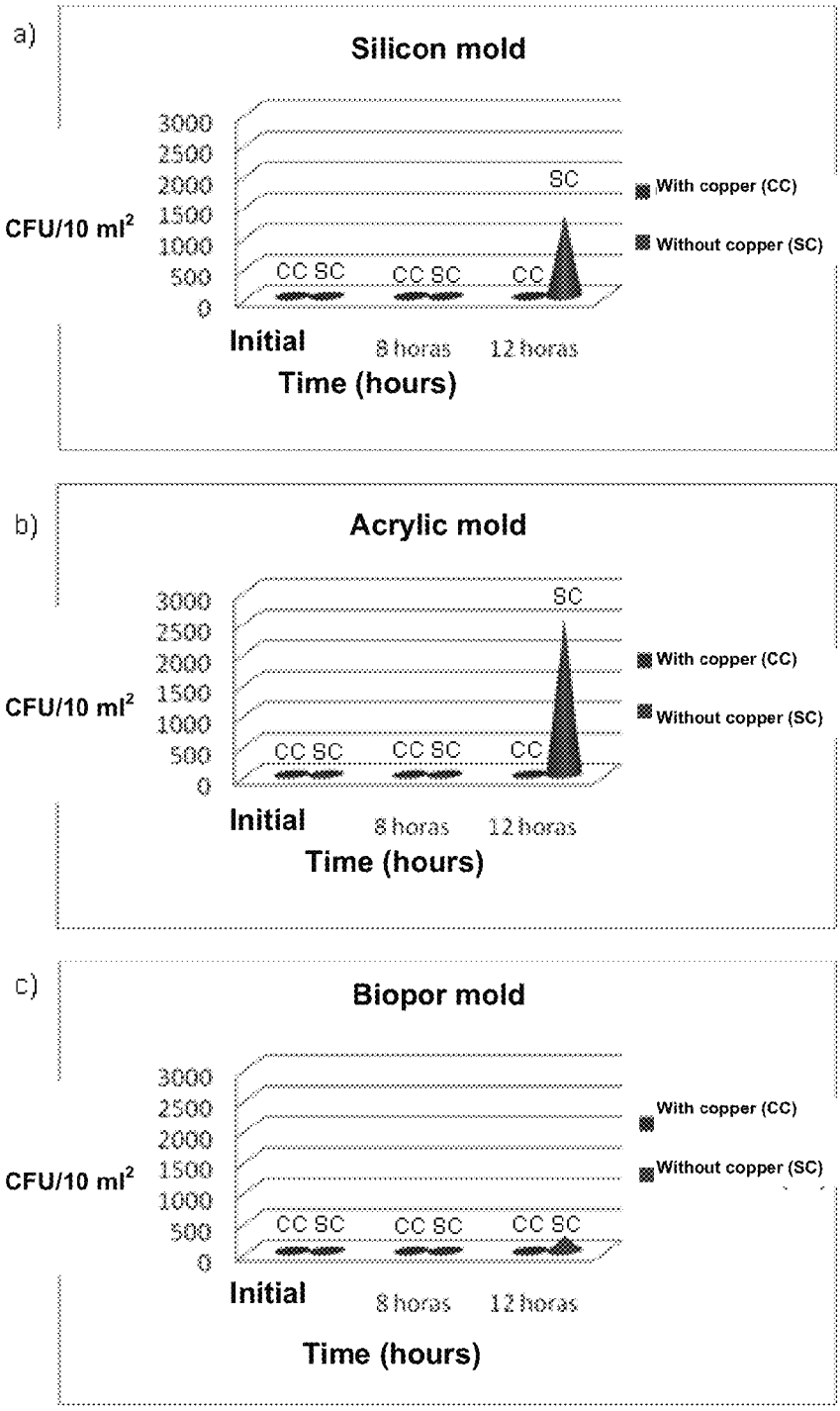
FIG. 11 shows a comparison between the adherence of *Aspergillus niger* using an initial inoculum of $9.4\times10^4$ CFU/ml, for different materials used as mold for earphones, including a copper plate inside or lacking the copper plate.

FIGS. 8 and 11 show that the adherence of microorganisms to the mold, for different materials, after 4, 8 and 12 hours of contact between the microorganism and the mold (silicon, acrylic, and UV sensitive polymer) is strongly diminished when using a copper plate inside the mold, finding in some cases up to 100% for each of the materials tested, which without question shows the effect of inserting a copper plate inside the mold and wherein said plate is completely covered with the materials conforming said earpiece device, such as silicon, acrylic and UV sensitive polymer or mixtures of these materials.

Different assays using different thickness of the biocide metallic piece (from 3 to 10 mm) were performed, showing that to a higher volume of the piece is a higher biocide effect, having the material of the device always covering this piece.

Additional results obtained in the development of this work, allowed the inventors to note interesting properties of the different materials used in the fabrication of earpiece molds: silicon, acrylic and UV sensitive polymer. Thus, considering the last one by itself (without a copper plate) the UV sensitive polymer was able to produce a lower adherence of all the studied microorganisms. This action was increased when a copper plate was included in the fabrication, transforming the evaluated material in the best evaluated material in our study, therefore, there is a synergic effect by adding a copper plate to this type of mold (UV sensitive polymer), which is due to the inherent properties of the material, for example, density and its insulating properties, which favors that the copper diffuses through the material and exerts its capacity as donor and receptor of electrons, derived from its high oxidation-reduction potential, and thus, exerting its antimicrobial action.

What is claimed is:

1. A mold for earpiece devices, either to connect an earphone to the ear canal or acting as a cover or plug thereof, allowing to prevent development of ear diseases, comprising:

a mold placed in the ear canal and/or ear shell, adjusted to its shape, wherein a border of the external surface of the mold is configured to be in direct contact with skin of a user's ear; and a metallic piece with biocide properties, located inside the mold at a distance close to the border thereof;

wherein the metallic piece is adjusted from inside the mold to the shape of the external surface of the mold, and wherein only the mold is in direct contact with the skin, and encompassing all the zones that are configured to be in direct contact with skin of the user's ear.

2. A mold for earpiece devices according to claim 1, wherein the metallic piece is positioned at a distance of 0.1 to 2 mm of the border of the external surface of the mold.

3. A mold for earpiece devices according to claim 1, wherein the metallic piece is selected from a group consisting of: a copper piece, a silver piece, an alloy thereof and a combination of said pieces.

4. A mold for earpiece devices according to claim 1, wherein the metallic piece is a metallic plate having a thickness between 0.1 mm and 3 mm.

5. A mold for earpiece devices according to claim 1, wherein the mold can be used for earphones, earplugs for aquatic sports, plugs related to acoustic trauma, or earpiece devices in direct contact with the ear canal.

6. A mold for earpiece devices according to claim 1, wherein the material used for the fabrication of said mold is acrylic, silicon, UV sensitive polymers, vinyl, polyethylene, plastics, polyurethane, elastomeric polymers, and PVC or mixtures thereof.

7. A mold for earpiece devices according to claim 1, wherein the material used for the fabrication of said mold is a UV sensitive polymer and has inside a copper piece.

* * * * *